US009031480B2

(12) United States Patent
Suzuki et al.

(10) Patent No.: US 9,031,480 B2
(45) Date of Patent: May 12, 2015

(54) TRANSFER DEVICE INCLUDING A SELECTIVELY OUTPUTTING POWER SUPPLY, IMAGE FORMING APPARATUS INCLUDING THE SAME, AND METHOD OF TRANSFERRING DEVELOPER TO SHEET

(71) Applicants: Katsuhito Suzuki, Kanagawa (JP); Masahide Nakaya, Kanagawa (JP); Tomokazu Takeuchi, Tokyo (JP); Shinya Tanaka, Kanagawa (JP)

(72) Inventors: Katsuhito Suzuki, Kanagawa (JP); Masahide Nakaya, Kanagawa (JP); Tomokazu Takeuchi, Tokyo (JP); Shinya Tanaka, Kanagawa (JP)

(73) Assignee: Ricoh Company, Limited, Tokyo (JP)

( * ) Notice: Subject to any disclaimer, the term of this patent is extended or adjusted under 35 U.S.C. 154(b) by 30 days.

(21) Appl. No.: 13/770,500

(22) Filed: Feb. 19, 2013

(65) Prior Publication Data

US 2013/0216281 A1 Aug. 22, 2013

(30) Foreign Application Priority Data

Feb. 20, 2012 (JP) ..... 2012-034434

(51) Int. Cl.

| | |
|---|---|
| ***G03G 15/20*** | (2006.01) |
| ***G03G 15/16*** | (2006.01) |
| ***G03G 13/16*** | (2006.01) |

(52) U.S. Cl.

CPC ..... *G03G 15/1635* (2013.01); *G03G 13/16* (2013.01); *G03G 15/1605* (2013.01); *G03G 15/1675* (2013.01)

(58) Field of Classification Search

CPC ..... G03G 15/1675
USPC ..... 399/314, 66, 88; 307/2
See application file for complete search history.

(56) References Cited

U.S. PATENT DOCUMENTS

| | | | | |
|---|---|---|---|---|
| 5,874,841 | A * | 2/1999 | Majid et al. | 327/94 |
| 7,555,236 | B2 * | 6/2009 | Saeki | 399/101 |
| 2008/0260401 | A1 | 10/2008 | Shimazaki | |
| 2009/0244941 | A1 * | 10/2009 | Okada | 363/63 |
| 2009/0304403 | A1 * | 12/2009 | Inada | 399/44 |
| 2010/0245009 | A1 * | 9/2010 | Akiyama et al. | 336/175 |
| 2010/0303518 | A1 * | 12/2010 | Aimoto et al. | 399/314 |
| 2012/0045237 | A1 | 2/2012 | Aoki et al. | |
| 2012/0213536 | A1 | 8/2012 | Takeuchi | |
| 2012/0230715 | A1 | 9/2012 | Ogino et al. | |
| 2012/0237234 | A1 | 9/2012 | Sugimoto et al. | |
| 2012/0237271 | A1 | 9/2012 | Sengoku et al. | |
| 2012/0308250 | A1 | 12/2012 | Shimizu et al. | |
| 2012/0315058 | A1 | 12/2012 | Shimizu et al. | |
| 2012/0328314 | A1 | 12/2012 | Sugimoto et al. | |
| 2012/0328315 | A1 | 12/2012 | Takeuchi et al. | |

(Continued)

FOREIGN PATENT DOCUMENTS

| | | |
|---|---|---|
| JP | 4-263277 | 9/1992 |
| JP | 2008-058585 | 3/2008 |
| JP | 2012-042835 | 3/2012 |

*Primary Examiner* — Clayton E LaBalle
*Assistant Examiner* — Trevor J Bervik
(74) *Attorney, Agent, or Firm* — Oblon, McClelland, Maier & Neustadt, L.L.P.

(57) ABSTRACT

A transfer device includes a direct-current (DC) power supply configured to output a DC voltage; an alternating-current (AC) power supply configured to selectively output a superimposed voltage in which an AC voltage is superimposed on the DC voltage output from the DC power supply or the DC voltage output from the DC power supply; and a transfer unit configured to transfer a developer to a sheet using the voltage output from the AC power supply.

10 Claims, 9 Drawing Sheets

(56) References Cited

U.S. PATENT DOCUMENTS

| | | | | |
|---|---|---|---|---|
| 2012/0328320 | A1 | 12/2012 | Fujita et al. | |
| 2012/0328321 | A1 | 12/2012 | Takeuchi et al. | |
| 2013/0004190 | A1 | 1/2013 | Sengoku et al. | |
| 2013/0011155 | A1 | 1/2013 | Ogiyama et al. | |
| 2013/0016989 | A1 | 1/2013 | Fujita et al. | |
| 2014/0029988 | A1* | 1/2014 | Shimizu et al. | 399/314 |
| 2014/0079421 | A1* | 3/2014 | Takeuchi | 399/66 |
| 2014/0079422 | A1* | 3/2014 | Suzuki | 399/66 |

* cited by examiner

TRANSFER DEVICE INCLUDING A SELECTIVELY OUTPUTTING POWER SUPPLY, IMAGE FORMING APPARATUS INCLUDING THE SAME, AND METHOD OF TRANSFERRING DEVELOPER TO SHEET

CROSS-REFERENCE TO RELATED APPLICATION

The present application claims priority to and incorporates by reference the entire contents of Japanese Patent Application No. 2012-034434 filed in Japan on Feb. 20, 2012.

BACKGROUND OF THE INVENTION

1. Field of the Invention

The present invention relates to a transfer device, an image forming apparatus, and a method of transferring a developer to a sheet.

2. Description of the Related Art

Electrophotographic image forming apparatuses typically transfer static toner patterns formed on image carriers to sheets by applying direct-current (DC) voltages to the static toner patterns to move developers such as toner forming the static toner patterns to the sheets.

Some types of sheets such as Leathac paper or Japanese paper having low surface smoothness with their surfaces having large ridges and valleys involve a problem in that prints on the valleys are pale because it is more difficult for developers to be transferred to the valleys than to the ridges.

To address such a problem, a technique has been developed in which an alternating-current (AC) voltage is superimposed on a DC voltage used for a transfer operation to oscillate a developer, thereby increasing a transfer rate of the developer to the valleys (e.g., Japanese Patent Application Laid-open No. 2008-058585).

In such a conventional technique, however, the developer scatters, thereby causing bleeding of images because the developer is oscillated. Accordingly, sheets having high surface smoothness with their surfaces having smaller ridges and valleys preferably undergo a transfer operation using a DC voltage.

Therefore, there is a need for a transfer device that can improve image quality regardless of the surface smoothness of sheets and an image forming apparatus including the transfer device.

SUMMARY OF THE INVENTION

It is an object of the present invention to at least partially solve the problems in the conventional technology.

According to an embodiment, there is provided a transfer device that includes a direct-current (DC) power supply configured to output a DC voltage; an alternating-current (AC) power supply configured to selectively output a superimposed voltage in which an AC voltage is superimposed on the DC voltage output from the DC power supply or the DC voltage output from the DC power supply; and a transfer unit configured to transfer a developer to a sheet using the voltage output from the AC power supply.

According to another embodiment, there is provided an image forming apparatus that includes the transfer device according to the above embodiment.

According to still another embodiment, there is provided a method of transferring a developer to a sheet. The method includes selectively outputting, from an alternating-current (AC) power supply, a superimposed voltage in which an AC voltage is superimposed on a DC voltage output from a direct-current (DC) power supply or the DC voltage output from the DC power supply; and transferring a developer to a sheet using the voltage output from the AC power supply.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

Embodiments of a transfer device and an image forming apparatus according to the present invention are described in detail below with reference to the accompanying drawings. In the following embodiments, an example is described in which the image forming apparatus of the invention is applied to an electrophotographic monochrome copier. The invention, however, is not limited to being applied to the monochrome copier. The invention can be applied to any apparatuses that form images by electrophotography, regardless of monochrome or color images, such as electrophotographic copiers and multifunction peripherals (MFPs). The MFPs have at least two functions out of the printing, copying, scanning, and facsimile functions.

First Embodiment

A structure of a copying system according to a first embodiment of the present invention is described below.

Figure 1:
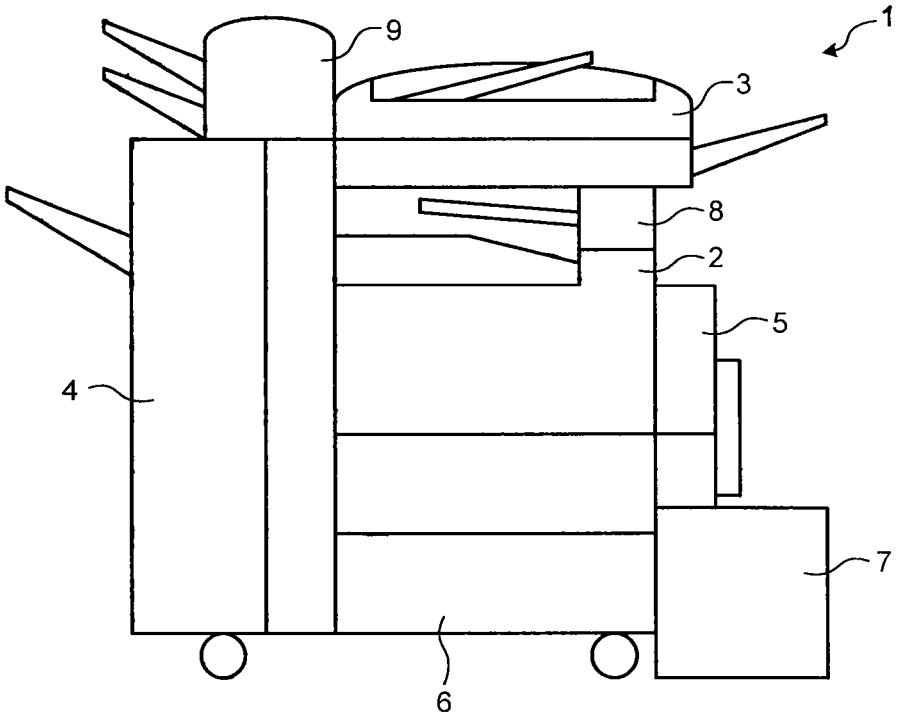
FIG. 1 is a schematic diagram illustrating an exemplary overall structure of a copying system according to a first embodiment of the present invention.

FIG. 1 is a schematic diagram illustrating an exemplary overall structure of a copying system 1 in the first embodiment. As illustrated in FIG. 1, the copying system 1 includes a copier 2, an auto document feeder (ADF) 3, a finisher 4, a duplex reversing unit 5, an extended paper feed tray 6, a large capacity paper feed tray 7, an insert feeder 8, and a one-bin discharge tray 9.

The copier 2, which is the main body of the copying system 1, includes a scanning unit that electronically reads documents and produces image data, an image forming unit that forms images based on the image data produced by the scanning unit, a feeding unit that feeds sheets, and a transfer unit that transfers the formed images to the sheets (the scanning unit and the feeding unit are omitted to be illustrated in the accompanying drawings while the image forming unit and the transfer unit are omitted in FIG. 1). Hereinafter, a sheet on which an image has been transferred is also referred to as a copy.

The ADF 3 automatically sends documents to the copier 2 (specifically, to the scanning unit of the copier 2).

The finisher 4 is a so-called post-processing unit that includes has a stapler and shift trays, and performs post-processing such as a stapling process on copies produced by the copier 2, for example. The processing performed by the finisher 4 is not limited to the stapling process. The finisher 4 may perform post-processing such as a punching process and a folding process besides the stapling process.

The duplex reversing unit 5 reverses a sheet on which an image has been transferred and returns the sheet to the copier 2 (specifically, the transfer unit of the copier 2) when duplex copying is performed on the sheet.

The extended paper feed tray 6, which is an optional tray for sheets in various sizes, sends the sheets to the transfer unit of the copier 2.

The large capacity paper feed tray 7, which can store a larger number of sheets than those stored in the feeding unit and the extended paper feed tray 6 of the copier 2, sends the sheets to the transfer unit of the copier 2.

The insert feeder 8 sends sheets such as a cover sheet and slip sheets to the transfer unit of the copier 2.

The one-bin discharge tray 9, which is composed of bins (discharge trays) each of which serves as an individual discharge destination, receives copies produced and discharged by the copier 2.

Figure 2:
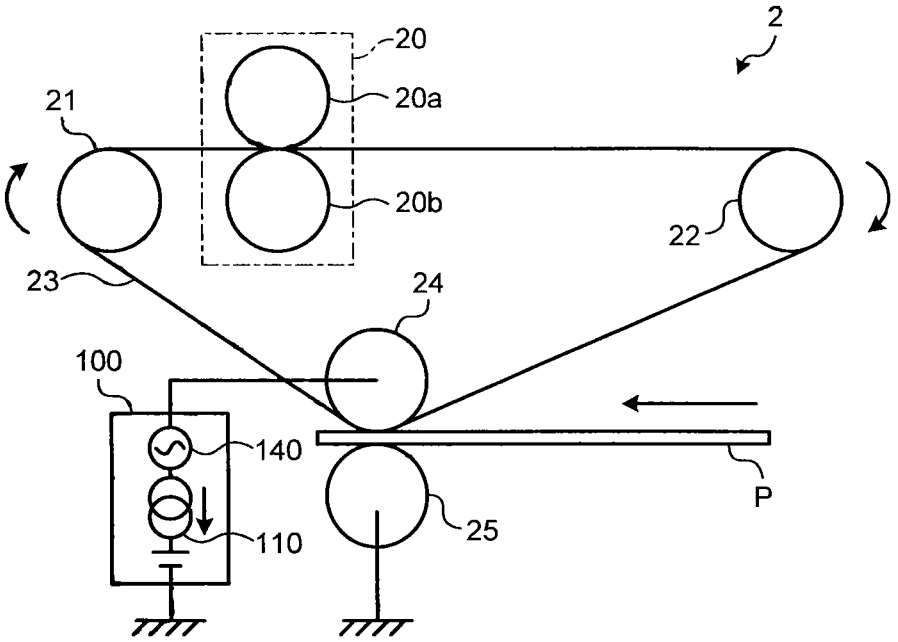
FIG. 2 is a schematic diagram illustrating an exemplary structure relating to the image forming and transfer operation performed by a copier in the first embodiment.

FIG. 2 is a schematic diagram illustrating an exemplary structure relating to the image forming and transfer operation performed by the copier 2 in the first embodiment. As illustrated in FIG. 2, the copier 2 includes an image forming unit 20, driving rollers 21 and 22, an intermediate transfer belt 23, a repulsive force roller 24, a secondary transfer roller 25, and a secondary transfer power supply 100.

The image forming unit 20 includes a photosensitive drum 20*a*, a charging device, a developing device, a primary transfer roller 20*b*, and a cleaning device (the charging device, the developing device, and the cleaning device are not illustrated).

The image forming unit 20 and an irradiating device (not illustrated) perform an image forming process (charging process, irradiating process, developing process, transfer process, and cleaning process) on the photosensitive drum 20*a* to form a static toner pattern on the photosensitive drum 20*a* and the image forming unit 20 transfers the static toner pattern to the intermediate transfer belt 23.

In the charging process, the charging device (not illustrated) charges a surface of the photosensitive drum 20*a* being rotated.

Then, in the irradiating process, the irradiating device (not illustrated) irradiates the charged surface of the photosensitive drum 20*a* with optically modulated laser light to form a static latent image on the surface of the photosensitive drum 20*a*.

Then, in the developing process, the developing device (not illustrated) develops the static latent image formed on the photosensitive drum 20*a* using toner (an example of a developer). As a result, a static toner pattern, which is a toner image obtained by developing the static latent image using the toner, is formed on the photosensitive drum 20*a*.

Then, in the transfer process, the primary transfer roller 20*b* transfers the static toner pattern formed on the photosensitive drum 20*a* to the intermediate transfer belt 23 (primary transfer). A slight amount of non-transferred toner remains on the photosensitive drum 20*a* after the static toner pattern is transferred.

Then, in the cleaning process, the cleaning device (not illustrated) removes the non-transferred toner remaining on the photosensitive drum 20*a*.

In the first embodiment, the single image forming unit is provided because the copier 2 performs copying in monochrome. When the copier 2 can perform copying in color, a plurality of image forming units are provided in accordance with the number of colors of toner to be used. In this case, the image forming units have the same structure and operation while colors of toner used in the respective image forming units differ from each other.

The intermediate transfer belt 23, which is an endless belt wound along a plurality of rollers such as the driving rollers 21 and 22 and the repulsive force roller 24, is moved by the rotation of one of the rotationally driven driving rollers 21 and 22.

The intermediate transfer belt 23, to which the static toner pattern is transferred by the image forming unit 20 (the primary transfer roller 20*b*), conveys the transferred static toner pattern to a gap between the repulsive force roller 24 and the secondary transfer roller 25. In synchronization with conveying timing of the static toner pattern, a sheet P is conveyed by the feeding unit (not illustrated) to the gap between the repulsive force roller 24 and the secondary transfer roller 25. As a result, the transfer positions of the static toner pattern and the sheet P coincide with each other.

In the first embodiment, examples of the sheet P include Leathac paper having low surface smoothness (with its surface having larger ridges and valleys) and plain paper having high surface smoothness (with its surface having smaller ridges and valleys). The paper P, however, is not limited to these types of paper.

The repulsive force roller 24 (an example of the transfer unit) transfers the static toner pattern conveyed by the intermediate transfer belt 23 to the sheet P (secondary transfer) at a secondary transfer nip (not illustrated) formed between itself and the secondary transfer roller 25. The repulsive force roller 24 is connected to the secondary transfer power supply 100, which is a power supply for applying a transfer bias. The secondary transfer roller 25 is earthed.

The secondary transfer power supply 100 applies a high voltage to the repulsive force roller 24 at timing of the secondary transfer performed by the repulsive force roller 24 and the secondary transfer roller 25. In the copier 2, toner is charged to a negative polarity in the same manner as typical image forming apparatuses. Accordingly, the secondary transfer power supply 100 applies a high voltage having a negative polarity to the repulsive force roller 24 such that the repulsive force roller 24 applies a repulsive force to the toner and transfers the static toner pattern.

The secondary transfer power supply 100 includes a direct-current (DC) power supply 110 and an alternating-current (AC) power supply 140 connected in series with the direct-current power supply 110. Hereinafter, "direct-current" is abbreviated as DC and "alternating-current" is abbreviated as AC. The DC power supply 110 outputs a DC voltage to the AC power supply 140. The AC power supply 140 selectively outputs a superimposed voltage in which an AC voltage is superimposed on the DC voltage output from the DC power supply 110 or the DC voltage output from the DC power supply 110 to the repulsive force roller 24.

Specifically, the secondary transfer power supply 100 (the AC power supply 140) applies the superimposed voltage or the DC voltage to the repulsive force roller 24 in accordance with user's settings. In the first embodiment, it is assumed that a user preliminarily sets the following settings as the user's settings: a setting that the superimposed voltage is applied to the repulsive force roller 24 when the sheet P is Leathac paper, and another setting that the DC voltage is applied to the repulsive force roller 24 when the sheet P is plain paper.

The applied voltage causes a potential difference to occur between the repulsive force roller 24 and the secondary transfer roller 25, thereby producing a voltage causing the toner to move from the intermediate transfer belt 23 to the sheet P. As a result, the static toner pattern can be transferred to the sheet P. That is, the repulsive force roller 24 transfers the toner to the sheet P using the voltage (the superimposed voltage or the DC voltage) output from the secondary transfer power supply 100 (the AC power supply 140).

If the sheet P is Leathac paper having low surface smoothness, toner is moved (oscillated) in both directions (in a transfer direction and its opposite direction) by the superimposed voltage in the transfer operation, thereby increasing a transfer rate of the toner at valleys and enabling the occurrence of density unevenness, for example, to be prevented. As a result, image quality can be improved. When the sheet P is plain paper having high surface smoothness, toner is moved in the transfer direction by the DC voltage in the transfer operation, thereby enabling a toner scattering to be prevented and thus the occurrence of bleeding in images, for example, to be prevented. As a result, image quality can be improved.

Once the static toner pattern is transferred to the sheet P, a fixing device (not illustrated) heats and presses the sheet P, thereby fixing the static toner pattern to the sheet P. The sheet P to which the static toner pattern has been fixed is discharged to the one-bin discharge tray 9 from the copier 2 (refer to FIG. 1).

Figure 3:
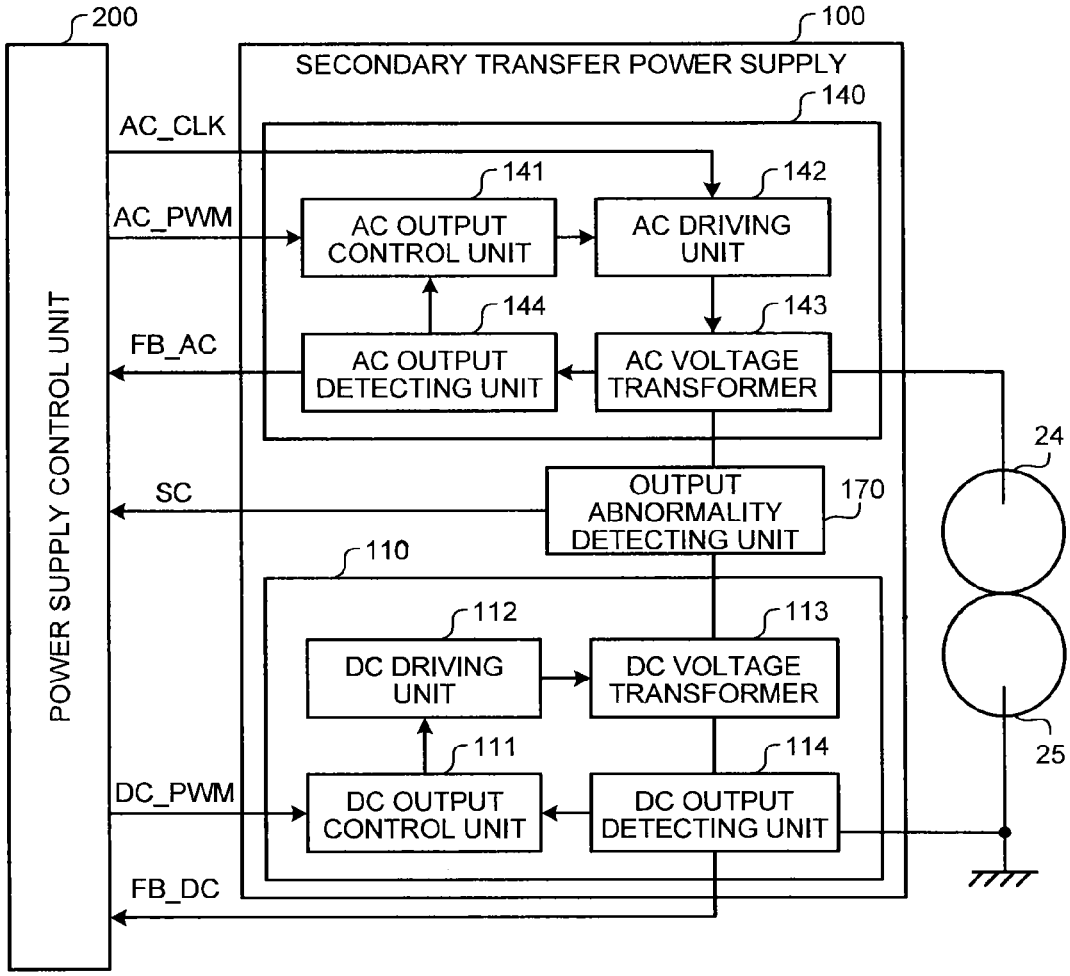
FIG. 3 is a block diagram illustrating an exemplary electrical structure of the copier in the first embodiment.

FIG. 3 is a block diagram illustrating an exemplary electrical structure of the copier 2 in the first embodiment. As illustrated in FIG. 3, the copier 2 includes the secondary transfer power supply 100 and a power supply control unit 200. The secondary transfer power supply 100 includes the DC power supply 110, the AC power supply 140, and an output abnormality detecting unit 170. The DC power supply 110, which is the power supply for toner transfer, includes a DC output control unit 111, a DC driving unit 112, a DC voltage transformer 113, and a DC output detecting unit 114. The AC power supply 140, which is the power supply for toner oscillation, includes an AC output control unit 141, an AC driving unit 142, an AC voltage transformer 143, and an AC output detecting unit 144. The power supply control unit 200 controls the secondary transfer power supply 100. The power supply control unit 200 can be achieved by a controller including a central processing unit (CPU), a read only memory (ROM), and a random access memory (RAM), for example.

The DC output control unit 111 receives a DC_PWM signal, which controls an output level of the DC voltage, input from the power supply control unit 200, and also receives, from the DC output detecting unit 114, an output value of the DC voltage transformer 113 detected by the DC output detecting unit 114. The DC output control unit 111 controls driving of the DC voltage transformer 113 through the DC driving unit 112 such that the output value of the DC voltage transformer 113 equals to the value indicated by the DC_PWM signal on the basis of a duty ratio of the input DC_PWM signal and the output value of the DC voltage transformer 113.

The DC driving unit 112 drives the DC voltage transformer 113 in accordance with the control of the DC output control unit 111.

The DC voltage transformer 113, which is driven by the DC driving unit 112, outputs a DC high voltage having a negative polarity.

The DC output detecting unit 114 detects the output value of the DC high voltage of the DC voltage transformer 113 and outputs the detected output value to the DC output control unit 111. The DC output detecting unit 114 outputs the detected output value to the power supply control unit 200 as an FB_DC signal (a feedback signal). The FB_DC signal is used in the power supply control unit 200 to control the DC_PWM signal such that transfer performance does not deteriorate by an environment or loads.

In the first embodiment, the DC power supply 110 performs constant current control. The control performed by the DC power supply 110, however, is not limited to the constant current control. The DC power supply 110 may perform constant voltage control.

The AC output control unit 141 receives an AC_PWM signal, which controls an output level of the AC voltage, input from the power supply control unit 200, and also receives, from the AC output detecting unit 144, an output value of the AC voltage transformer 143 detected by the AC output detecting unit 144. The AC output control unit 141 controls driving of the AC voltage transformer 143 through the AC driving unit 142 such that the output value of the AC voltage transformer 143 equals to the output value indicated by the AC_PWM signal on the basis of the duty ratio of the input AC_PWM signal and the output value of the AC voltage transformer 143.

The AC driving unit 142 receives an AC_CLK signal that controls an output frequency of the AC voltage. The AC driving unit 142 drives the AC voltage transformer 143 in accordance with the control of the AC output control unit 141 and the AC_CLK signal. The AC driving unit 142 can control an output waveform produced by the AC voltage transformer 143 so as to have any frequency indicated by the AC_CLK signal by controlling the AC voltage transformer 143 in accordance with the AC_CLK signal.

The AC voltage transformer 143 produces the AC voltage by being driven by the AC driving unit 142, produces the superimposed voltage by superimposing the produced AC voltage on the DC high voltage output from the DC voltage transformer 113, and outputs (applies) the produced superimposed voltage to the repulsive force roller 24. When producing no AC voltage, the AC voltage transformer 143 outputs (applies) the DC high voltage output from the DC voltage transformer 113 to the repulsive force roller 24. The voltage (superimposed voltage or DC voltage) output to the repulsive force roller 24 returns to the DC power supply 110 through the secondary transfer roller 25.

The AC output detecting unit 144 detects the output value of the AC voltage of the AC voltage transformer 143 and outputs the detected output value to the AC output control unit 141. The AC output detecting unit 144 outputs the detected output value to the power supply control unit 200 as an FB_AC signal (a feedback signal). The FB_AC signal is used in the power supply control unit 200 to control the AC_PWM signal such that the transfer performance does not deteriorate by an environment or loads.

In the first embodiment, the AC power supply 140 performs constant voltage control. The control performed by the AC power supply 140, however, is not limited to the constant voltage control. The AC power supply 140 may perform constant current control.

The AC voltage produced by the AC voltage transformer 143 (the AC power supply 140) may have a sine waveform or a rectangular waveform. In the first embodiment, the AC voltage has a short-pulsed rectangular waveform. This is because the AC voltage having a short-pulsed rectangular waveform can further improve image quality.

Figure 4:
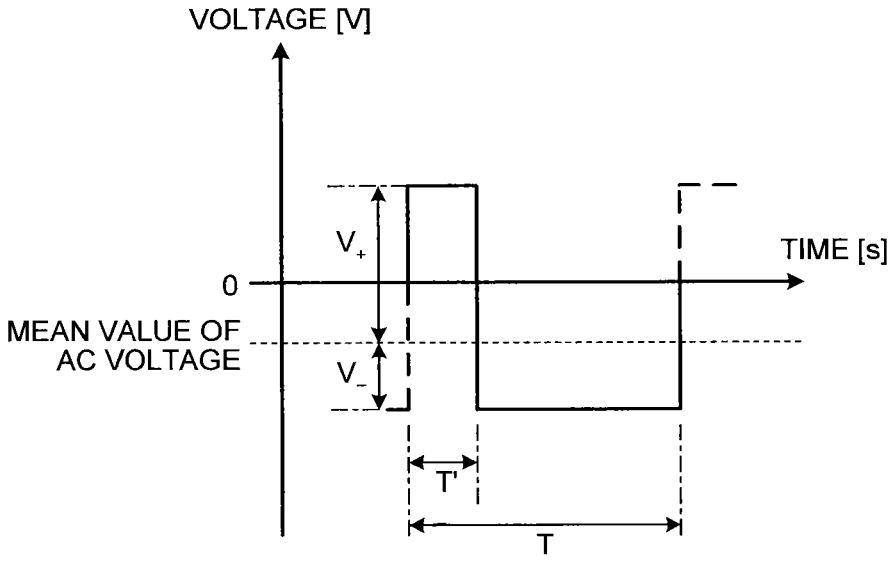
FIG. 4 is a schematic diagram illustrating an example of a superimposed voltage in which an alternating-current (AC) voltage having a short-pulsed rectangular waveform is superimposed on a direct-current (DC) voltage.
Figure 5:
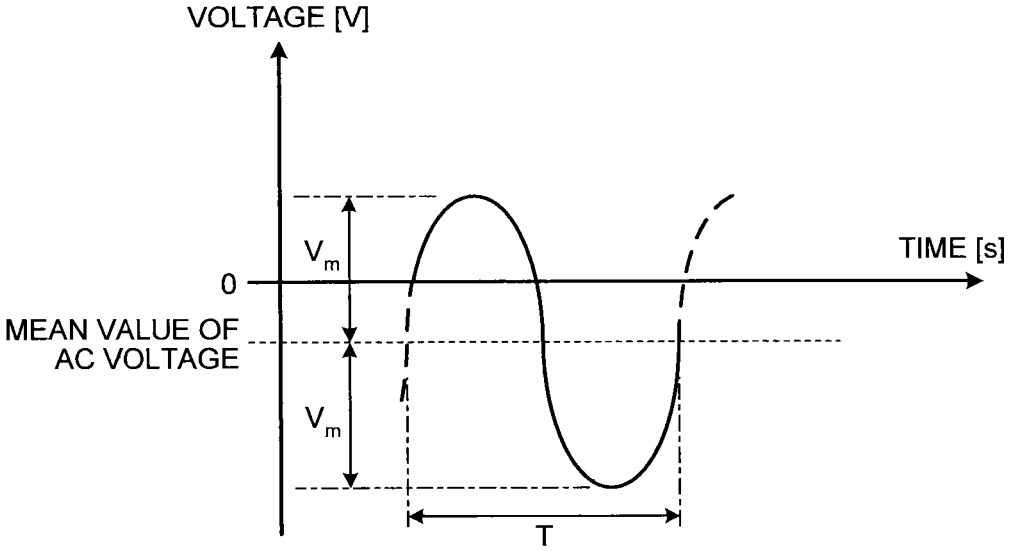
FIG. 5 is a schematic diagram illustrating an example of a superimposed voltage in which an AC voltage having a sine waveform is superimposed on the DC voltage.

Advantages of the short-pulsed rectangular wave relative to the sine wave are specified below. FIG. 4 is a schematic diagram illustrating an example of the superimposed voltage in which an AC voltage having a short-pulsed rectangular waveform is superimposed on a DC voltage. FIG. 5 is a schematic diagram illustrating an example of the superimposed voltage in which an AC voltage having a sine waveform is superimposed on the DC voltage.

In general, an AC voltage can be expressed in terms of time. The superimposed voltage illustrated in FIG. 4 can be represented by Equations (1) and (2). The superimposed voltage illustrated in FIG. 5 can be represented by Equation (3).

$$V(s)=V_{+}\ (0\leq s\leq T') \tag{1}$$

$$V(s)=V_{-}\ (T'\leq s\leq T) \tag{2}$$

$$V(s)=V_{m}\sin\omega s \tag{3}$$

where s represents time, $V_+$ represents a peak value in the positive polarity phase of the pulsed voltage (also referred to as the positive polarity peak value), $V_-$ represents a peak value in the negative polarity phase of the pulsed voltage (also referred to as the negative polarity peak value), T represents a period of the waveform of the pulsed voltage, and T' represents a polarity switching point. Positive polarity output energy is equal to negative polarity output energy in relation to the pulsed voltage. Thus, the relationship can be represented by Equation (4).

$$V_{+}\times T'=V_{-}\times(T-T') \tag{4}$$

In Equation (3), $V_m$ represents an amplitude of sine wave and ω represents an angular velocity.

In both of the superimposed voltages illustrated in FIGS. 4 and 5, the AC voltage is superimposed on the negative polarity DC voltage. That is, the positive polarity electric energy and the negative polarity electric energy are periodically added to a mean value (a negative value) of the superimposed voltage, which is the value of the negative polarity DC voltage. Toner is oscillated in the transfer direction and its opposite direction by the positive polarity electric energy periodically added thereto. As a result, an amount of toner sticking to the valleys of a sheet increases. On the other hand, the negative polarity electric energy is periodically added. Accordingly, the negative polarity voltage increases, resulting in a peak value of the negative polarity voltage being smaller than the mean value of the superimposed voltage.

An excess increase in the negative polarity voltage causes aerial discharge to occur, thereby causing white spots on the ridges of the sheet. Thus, the negative polarity peak value is preferably smaller than the positive polarity peak value. However, such adjustment is difficult in the superimposed voltage illustrated in FIG. 5, in which the AC voltage having a sine waveform is superimposed on the DC voltage, because each of the negative polarity peak value and the positive polarity peak value is the amplitude $V_m$ of sine wave. In contrast, in the first embodiment as illustrated in FIG. 4, the AC voltage having a short-pulsed rectangular waveform is superimposed on the DC voltage, and the negative polarity peak value $V_-$ is smaller than the positive polarity peak value $V_+$. As a result, the occurrence of the white spots on the ridges of the sheet can be prevented, thereby improving image quality.

Let the peak values in the positive polarity phase of the superimposed voltages illustrated in FIGS. 4 and 5 be equal to each other ($V_+=V_m$), $V_-$ can be represented by Equation (5).

$$V_{-}=V_{m}\times T'/T-T' \tag{5}$$

The inventor(s) of the present invention found that the bleeding in images was reduced when T' was about 10% to 20% of T. It is conceivable that toner is moved more steeply by the positive polarity voltage in the superimposed voltage having a short-pulsed rectangular waveform than the positive polarity voltage in the superimposed voltage having a sine waveform because the positive polarity voltage is applied in a short period of time in the short-pulsed rectangular wave, thereby reducing the toner scattering.

In the first embodiment, as illustrated in FIG. 4, the superimposed voltage is used in which the AC voltage having a short-pulsed rectangular waveform is superimposed on the DC voltage and T' is set to about 10% to 20% of T, thereby reducing the bleeding in images and improving image quality.

When T' is set to about 10% to 20% of T, $V_-$ is about 11% to 25% of $V_m$. Accordingly, a margin of aerial discharge can be obtained in a range from about $V_m\times 3/4$ to $V_m\times 8/9$ relative to that of the superimposed voltage illustrated in FIG. 5. As a result, the occurrence of white spots on ridges of sheets can be prevented.

Referring back to FIG. 3, the output abnormality detecting unit 170 is disposed in an output line of the secondary transfer power supply 100 and outputs an SC signal to the power supply control unit 200 when an output abnormality occurs due to an earth fault of a cable, for example. The SC signal enables the power supply control unit 200 to perform control to stop the output of a high voltage from the secondary transfer power supply 100.

Figure 6:
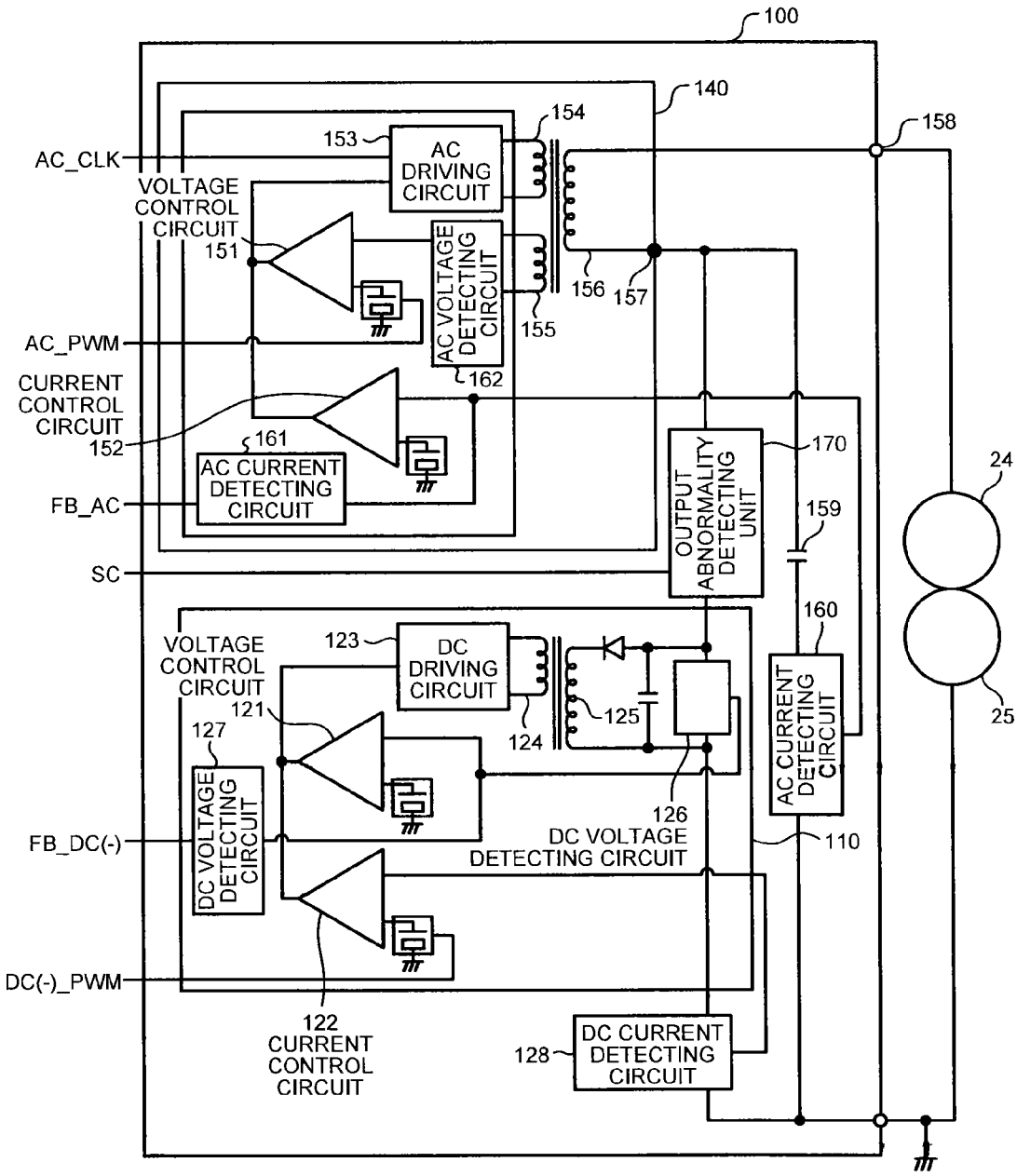
FIG. 6 is a circuit diagram illustrating an exemplary structure of a secondary transfer power supply in the first embodiment.

FIG. 6 is a circuit diagram illustrating an exemplary structure of the secondary transfer power supply 100 in the first embodiment.

The DC power supply 110 receives a DC(−)_PWM signal input from the power supply control unit 200, integrates the input DC(−)_PWM signal, and inputs the resulting signal to a current control circuit 122 (comparator). The value of the integrated DC(−)_PWM signal is a reference voltage of the current control circuit 122. A DC current detecting circuit 128 detects a DC current output by the DC power supply 110 in the output line of the secondary transfer power supply 100 and inputs the output value of the detected DC current to the current control circuit 122. The current control circuit 122 positively drives a DC driving circuit 123 of a DC high voltage transformer when the DC current is smaller than the reference voltage while the current control circuit 122 regulates the driving of the DC driving circuit 123 of the DC high voltage transformer when the DC current is larger than the reference voltage. In this way, the DC power supply 110 maintains constant current control.

A DC voltage detecting circuit 126 detects the DC voltage output by the DC power supply 110 and inputs the output value of the detected DC voltage to a voltage control circuit 121 (comparator). The voltage control circuit 121 regulates the driving of the DC driving circuit 123 of the DC high voltage transformer when the output value of the DC voltage reaches an upper limit. A DC voltage detecting circuit 127 feeds back the output value of the DC voltage detected by the DC voltage detecting circuit 126 to the power supply control unit 200 as a FB_DC (−) signal.

Outputs produced in a primary winding N1_DC(−) 124 and a secondary winding N2_DC(−) 125 of the DC high voltage transformer by the driving of the DC driving circuit 123 in accordance with the control of the current control circuit 122 and the voltage control circuit 121 are smoothed by a diode and a capacitor. The smoothed output is input to the AC power supply 140 through an AC power supply input unit 157 as a DC voltage and applied to a secondary winding N2_AC 156 of an AC high voltage transformer.

The AC power supply 140 receives the AC_PWM signal input from the power supply control unit 200. The AC_PWM signal is input to a voltage control circuit 151 (comparator). The value of the input AC_PWM signal is a reference voltage of the voltage control circuit 151. An AC voltage detecting circuit 162 predicts an output value of the AC voltage on the basis of a mutual induction voltage produced by a primary winding N3_AC 155 of the AC high voltage transformer and inputs the predicted output value of the AC voltage to the voltage control circuit 151. The reason why the output value is predicted is that it is difficult to detect only the output (AC voltage) of the AC power supply 140 in the output line of the secondary transfer power supply 100 because the AC voltage is superimposed on the DC voltage. The voltage control circuit 151 positively drives an AC driving circuit 153 of the AC high voltage transformer when the AC voltage is smaller than the reference voltage while the voltage control circuit 151 regulates the driving of the AC driving circuit 153 of the AC high voltage transformer when the AC voltage is larger than the reference voltage. In this way, the AC power supply 140 maintains constant voltage control.

An AC current detecting circuit 160 detects an AC current on a low voltage side of an AC bypass capacitor 159 in the output line of the secondary transfer power supply 100, and inputs the output value of the detected AC current to a current control circuit 152 (comparator). The current control circuit 152 regulates the driving of the AC driving circuit 153 of the AC high voltage transformer when the output value of the AC current reaches an upper limit. An AC detecting circuit 161 feeds back the output value of the detected AC current to the power supply control unit 200 as the FB_AC signal.

The AC driving circuit 153 of the AC high voltage transformer is driven in accordance with the AC_CLK signal input from the power supply control unit 200, and the AND logic of the voltage control circuit 151 and the current control circuit 152 so as to produce an output having the same period as the AC_CLK signal.

An AC voltage produced in a primary winding N1_AC 154 by the driving of the AC driving circuit 153 is superimposed on the DC voltage applied to the secondary winding N2_AC 156 and output (applied) to the repulsive force roller 24 through a high voltage output unit 158 as the superimposed voltage. When the AC power supply 140 does not operate, the DC voltage applied to the secondary winding N2_AC 156 is output (applied) to the repulsive force roller 24 through the high voltage output unit 158 without any change.

In general, the secondary winding of a booster transformer is connected to the ground potential and to a high voltage output terminal. Accordingly, it is not assumed that a high voltage is present (applied) on a low voltage side (input side) of the secondary winding. In the first embodiment, however, the voltage on the low voltage side (input side) of the secondary winding is higher than that in the typical transformer because when the secondary transfer power supply 100 outputs the superimposed voltage, the DC high voltage produced by the DC power supply 110 is input on the low voltage side (input side) of the secondary winding N2_AC 156 and in addition the AC voltage is superimposed thereon. As a result, when a typical AC high voltage transformer is used, leakage of current may occur inside the AC high voltage transformer due to poor insulation in the secondary winding.

In the first embodiment, a withstanding voltage performance of the AC high voltage transformer is enhanced such that the AC high voltage transformer can withstand not only a maximum output voltage of the secondary transfer power supply 100 (a maximum value of the superimposed voltage), i.e., a maximum output voltage of the AC power supply 140 but also the maximum output voltage of the AC power supply 140 and a maximum output voltage of the DC power supply 110 when they are applied simultaneously.

Specifically, a pitch of winding on the low voltage side (input side) of the secondary winding N2_AC 156 of the AC high voltage transformer is larger than that of the typical AC high voltage transformer, thereby enabling the AC high voltage transformer to withstand the maximum output voltage of the secondary transfer power supply 100.

In general, the voltage in the booster transformer is higher on the output side than the input side. Accordingly, the larger the pitch of the winding as the winding winds from the input side to the output side. More specifically, in the first embodiment, the pitch of the winding in the secondary winding N2_AC 156 on the low voltage side (input side) is set to a pitch capable of withstanding the maximum output voltage of the DC power supply 110 while the pitch of the winding in the secondary winding N2_AC 156 on the high voltage side (output side) is set to a pitch capable of withstanding the maximum output voltage of the secondary transfer power supply 100 (the maximum value of the superimposed voltage).

In the first embodiment, when only the DC voltage is output, a target value of the DC current (which corresponds to the reference voltage of the current control circuit 122) is about a few tens of percent larger than a target value of the DC current when the AC voltage is superimposed on the DC voltage and the resulting voltage is output. Likewise, a value of the DC voltage, when the output value of the DC current is the target value and the DC voltage is output alone, is larger than a value of the DC voltage, when the output value of the DC current is the target value and the AC voltage is superimposed on the DC voltage and output as the superimposed voltage.

It seems that the maximum output voltage of the AC power supply 140 and the maximum output voltage of the DC power supply 110 are not applied to the AC high voltage transformer simultaneously, and it is not necessary to require the AC high voltage transformer to have the withstanding voltage performance capable of withstanding the maximum output voltage of the AC power supply 140 and the maximum output voltage of the DC power supply 110 that are applied simultaneously.

However, the maximum output voltage of the AC power supply 140 and the maximum output voltage of the DC power supply 110 are sometimes applied to the AC high voltage transformer simultaneously depending on conditions such as resistance of sheets even when the AC voltage is superimposed on the DC voltage and the resulting voltage is output. Therefore, in the first embodiment, the withstanding voltage performance of the AC high voltage transformer is enhanced so as to withstand the maximum output voltage of the AC power supply 140 and the maximum output voltage of the DC power supply 110 that are applied simultaneously.

In addition, in the first embodiment, the withstanding voltage performance of the peripheral circuits of the secondary winding N2_AC 156, such as the AC driving circuit 153, the primary winding N1_AC 154, and the primary winding N3_AC 155, is enhanced besides the secondary winding N2_AC 156 of the AC high voltage transformer.

Specifically, the peripheral circuits of the secondary winding N2_AC 156 are arranged with respect to the secondary winding N2_AC 156 of the AC high voltage transformer so as to keep insulation distances from the secondary winding N2_AC 156 so as to be able to withstand the maximum output voltage of the secondary transfer power supply 100. In the first embodiment, the AC high voltage transformer includes the AC driving circuit 153, the primary winding N1_AC 154, the primary winding N3_AC 155, and the secondary winding N2_AC 156. Thus, they are arranged in the AC high voltage transformer so as to keep sufficient insulation distances from each other. The specific insulation distances can be determined in accordance with the maximum output voltage of the secondary transfer power supply 100, the structure and material of the AC high voltage transformer, the number of turns in the secondary winding N2_AC 156, and the thickness and material of an insulator in the AC high voltage transformer, for example.

In the first embodiment, both of the DC voltage and the AC voltage are output through the AC high voltage transformer. Therefore, the resistance value of the secondary winding N2_AC 156 is reduced using the winding having a diameter appropriate to the maximum output voltage of the secondary transfer power supply 100, resulting in the generation of a large amount of heat being prevented.

In the first embodiment as described above, the secondary transfer power supply 100 includes the DC power supply 110 and the AC power supply 140 connected in series with the DC power supply 110. The AC power supply 140 selectively outputs the superimposed voltage in which the AC voltage is superimposed on the DC voltage output from the DC power supply 110 or the DC voltage output from the DC power supply 110. Toner is transferred to a sheet using the voltage output from the AC power supply 140.

As a result, if the sheet is Leathac paper having low surface smoothness, toner is moved (oscillated) in both directions (in a transfer direction and its opposite direction) by the superimposed voltage in the transfer operation, thereby increasing the transfer rate of the toner at the valleys and enabling the occurrence of density unevenness, for example, to be prevented. Consequently, image quality can be improved. When the sheet is plain paper having high surface smoothness, toner is moved in the transfer direction by the DC voltage in the transfer operation, thereby enabling the toner scattering to be prevented and the occurrence of the bleeding in images, for example, to be prevented. As a result, image quality can be improved.

A technique may be applicable in which a low output DC power supply and an AC power supply for sheets having low surface smoothness are separated from the output path using a switching mechanism such as a relay, and the power supplies are connected when they are used. The technique, however, requires the low output DC power supply besides the DC power supply used for a transfer operation using sheets having high surface smoothness, thereby increasing the installation area and costs.

In contrast, in the first embodiment, the DC power supply can be used in common with different types of sheets, thereby enabling the installation area and costs to be reduced.

In the first embodiment, the withstanding voltage performance of the AC high voltage transformer is enhanced because a high voltage is applied on the low voltage side (input side) of the secondary winding of the AC high voltage transformer, thereby enabling the occurrence of leakage of current inside the AC high voltage transformer to be prevented, for example.

Second Embodiment

In a second embodiment of the present invention, a power supply structure differs from that in the first embodiment. Specifically, a secondary transfer power supply includes a cleaning power supply in addition to the DC power supply and the AC power supply. The secondary transfer power supply is described below.

In a copier according to the second embodiment, when no sheet is supplied between the repulsive force roller 24 and the secondary transfer roller 25 (hereinafter referred to as a sheet supply interval), toner sticking to the intermediate transfer belt 23 sticks to the secondary transfer roller 25, thereby contaminating the back surface of the succeeding sheet to be printed because the intermediate transfer belt 23 continues to rotate during a printing operation in the same manner as the typical image forming apparatuses. Particularly, in duplex printing, an image surface (print surface) is contaminated, thereby causing deterioration of image quality.

In the second embodiment, a DC voltage having a polarity (positive polarity) opposite to that of the DC voltage in the transfer operation is applied to the repulsive force roller 24 in the sheet supply interval, causing toner to electrically stick to the intermediate transfer belt 23, thereby preventing the contamination of the secondary transfer roller 25.

In the following description, differences from the first embodiment are mainly described. The same name and reference numeral of the first embodiment are given to the element having the same function as the first embodiment, and description thereof is omitted.

Figure 7:
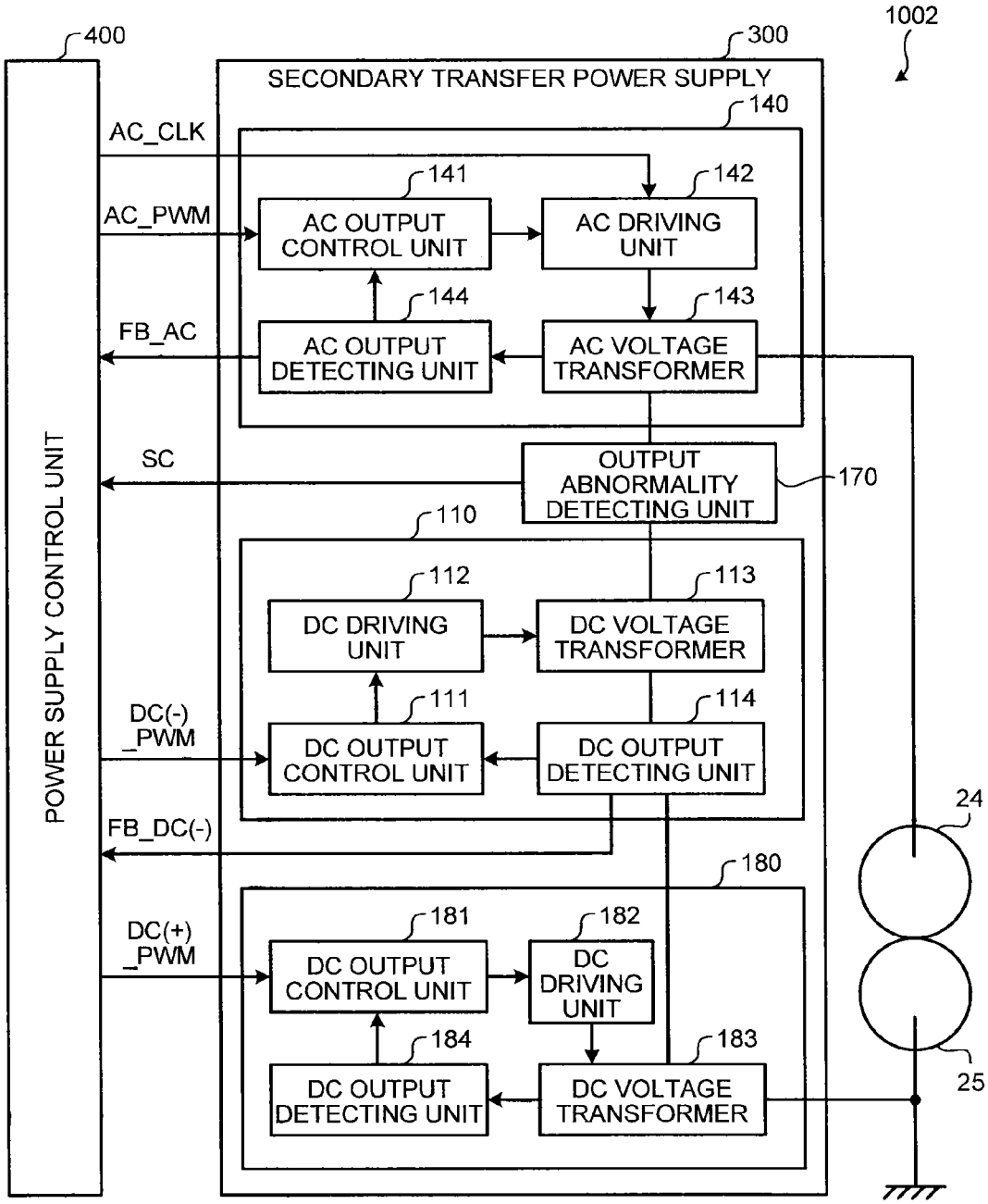
FIG. 7 is a block diagram illustrating an exemplary electrical structure of a copier according to a second embodiment of the present invention.

FIG. 7 is a block diagram illustrating an exemplary electrical structure of a copier 1002 in the second embodiment. A secondary transfer power supply 300 differs from the secondary transfer power supply 100 of the first embodiment in that the secondary transfer power supply 300 includes a cleaning power supply 180. A power supply control unit 400 differs from the power supply control unit 200 of the first embodiment in that the power supply control unit 400 outputs a DC(+)_PWM signal having a polarity (positive polarity) opposite to that of the DC(−)_PWM signal in the transfer operation. The cleaning power supply 180 includes a DC output control unit 181, a DC driving unit 182, a DC voltage transformer 183, and a DC output detecting unit 184.

The operation of the secondary transfer power supply 300 and the power supply control unit 400 in the toner transfer operation on sheets is the same as that in the first embodiment. The description thereof is thus omitted.

On the other hand, in the sheet supply interval, the DC output control unit 181 receives the DC(+)_PWM signal, which controls an output level of the positive polarity DC voltage, input from the power supply control unit 400, and also receives, from the DC output detecting unit 184, an output value of the DC voltage transformer 183 detected by the DC output detecting unit 184. In the sheet supply interval, the power supply control unit 400 stops outputting of the DC(−)_PWM signal, which controls an output level of the negative polarity DC voltage, to the DC output control unit 111. The DC output control unit 181 controls the driving of the DC voltage transformer 183 through the DC driving unit 182 such that the output value of the DC voltage transformer 183 equals to the value indicated by the DC(+)_PWM signal on the basis of the input duty ratio of the DC(+)_PWM signal and the output value of the DC voltage transformer 183.

When the toner transfer operation on a new sheet starts, the power supply control unit 400 stops outputting of the DC(+)_PWM signal, which controls an output level of the positive polarity DC voltage to the DC output control unit 181. Thereafter, the power supply control unit 400 performs the operation described in the first embodiment.

The DC driving unit 182 drives the DC voltage transformer 183 in accordance with the control of the DC output control unit 181.

The DC voltage transformer 183, which is driven by the DC driving unit 182, outputs a DC high voltage having a positive polarity. The DC voltage having a positive polarity is applied to the repulsive force roller 24 without any change because the DC power supply 110 and the AC power supply 140 do not operate.

The DC output detecting unit 184 detects the output value of the DC high voltage output of the DC voltage transformer 183 and outputs the detected output value to the DC output control unit 181.

In the second embodiment, the cleaning power supply 180 performs constant voltage control. The control performed by the cleaning power supply 180, however, is not limited to the constant voltage control. The cleaning power supply 180 may perform constant current control.

Figure 8:
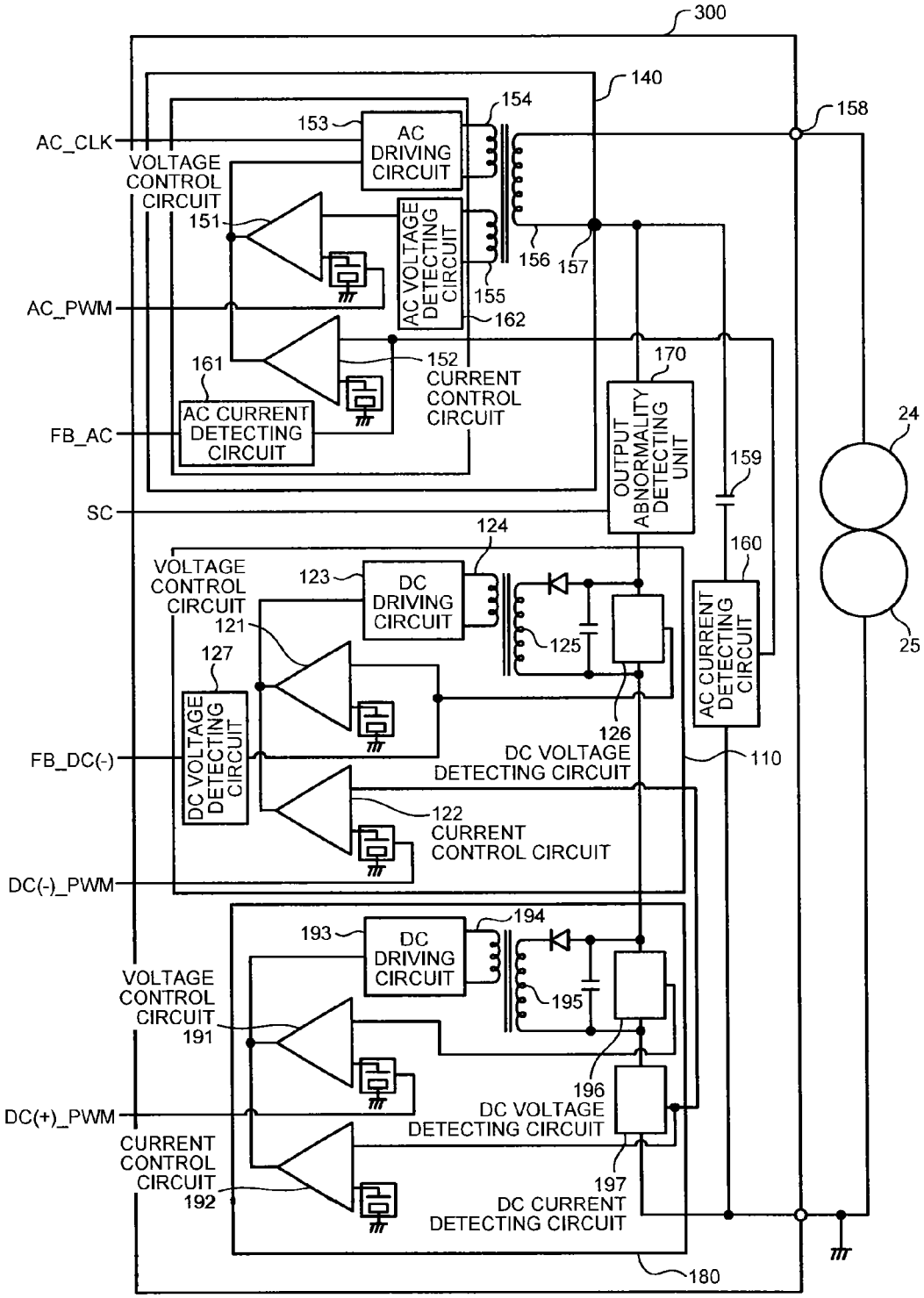
FIG. 8 is a circuit diagram illustrating an exemplary structure of a secondary transfer power supply in the second embodiment.

FIG. 8 is a circuit diagram illustrating an exemplary structure of the secondary transfer power supply 300 in the second embodiment. The secondary transfer power supply 300 differs from the secondary transfer power supply 100 of the first embodiment in that the secondary transfer power supply 300 includes the cleaning power supply 180.

The operation of the secondary transfer power supply 300 in the toner transfer operation on sheets is the same as that in the first embodiment. The description thereof is thus omitted.

In the sheet supply interval, the cleaning power supply 180 receives the DC(+)_PWM signal from the power supply control unit 400. The DC(+)_PWM signal is input to a voltage control circuit 191 (comparator). The value of the input DC(+)_PWM signal is a reference voltage of the voltage control circuit 191. A DC voltage detecting circuit 196 detects a DC voltage output by the cleaning power supply 180 in the output line of the secondary transfer power supply 300 and inputs the output value of the detected DC voltage to the voltage control circuit 191. The voltage control circuit 191 positively drives a DC driving circuit 193 of a DC high voltage transformer when the DC voltage is smaller than the reference voltage while the voltage control circuit 191 regulates the driving of the DC driving circuit 193 of the DC high voltage transformer when the DC voltage is larger than the reference voltage. In this way, the cleaning power supply 180 maintains constant voltage control.

A DC current detecting circuit 197 detects a DC current output by the cleaning power supply 180 and inputs the output value of the detected DC current to a current control circuit 192 (comparator). The current control circuit 192 regulates the driving of the DC driving circuit 193 of the DC high voltage transformer when the output value of the DC current reaches an upper limit.

Outputs produced in a primary winding N1_DC(+) 194 and a secondary winding N2_DC(+) 195 of the DC high voltage transformer by the driving of the DC driving circuit 193 in accordance with the control of the current control circuit 192 and the voltage control circuit 191 are smoothed by a diode and a capacitor. The smoothed output is input to the AC power supply 140 through the AC power supply input unit 157 as a DC voltage and applied to the secondary winding N2_AC 156. In the sheet supply interval, the DC voltage applied to the secondary winding N2_AC 156 is output (applied) to the repulsive force roller 24 through the high voltage output unit 158 without any change because the DC power supply 110 and the AC power supply 140 do not operate.

The structure in the second embodiment is also required to enhance the withstanding voltage performance of the AC high voltage transformer in the same manner as the first embodiment. The countermeasure for enhancing the withstanding voltage performance may be carried out in the same manner as the first embodiment because the maximum output voltage of the secondary transfer power supply 300 in the second embodiment is the same as that of the secondary transfer power supply 100 in the first embodiment.

As described above, the second embodiment can prevent sheets from being contaminated with remaining toner, thereby enabling image quality to be improved.

Modifications

The present invention is not limited to the above-described embodiments and various modifications can be made.

First Modification

Figure 9:
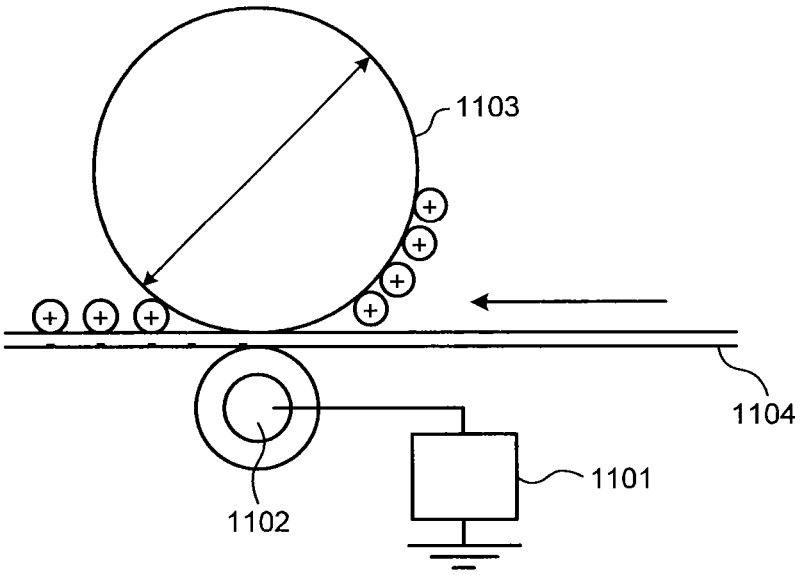
FIG. 9 is an explanatory view of a first modification.

In a structure illustrated in FIG. 9, the power supply structures of the embodiments may be applied to a power supply 1101. In the structure illustrated in FIG. 9, a mid-resistance transfer roller 1102 makes contact with a photosensitive drum 1103, transfers toner to a sheet 1104 using a bias applied from the power supply 1101 to the transfer roller 1102, and conveys the sheet 1104.

The structure of the image forming unit including the photosensitive drum 1103 is the same as that of the first embodiment. A transfer roller 1102 is composed of a metallic cored bar made of stainless steel or aluminum, for example, and a resistive layer that is made of a conductive sponge and formed on the outer periphery of the metallic cored bar. A surface layer made of a fluorine resin, for example, may be provided to the surface of the resistive layer.

The photosensitive drum 1103 and the transfer roller 1102 are abutted and a transfer nip (not illustrated) is formed at the abutting area. The photosensitive drum 1103 is earthed while the transfer roller 1102 is connected to the power supply 1101 from which a transfer bias is applied to the transfer roller 1102. As a result, a transfer electric field that causes toner to electro-statically move from the photosensitive drum 1103 toward the transfer roller 1102 is formed between the photosensitive drum 1103 and the transfer roller 1102, and a toner image on the photosensitive drum 1103 is transferred, by actions of the transfer electric field and nip pressure, to the sheet 1104 fed toward the transfer nip.

Second Modification

Figure 10:
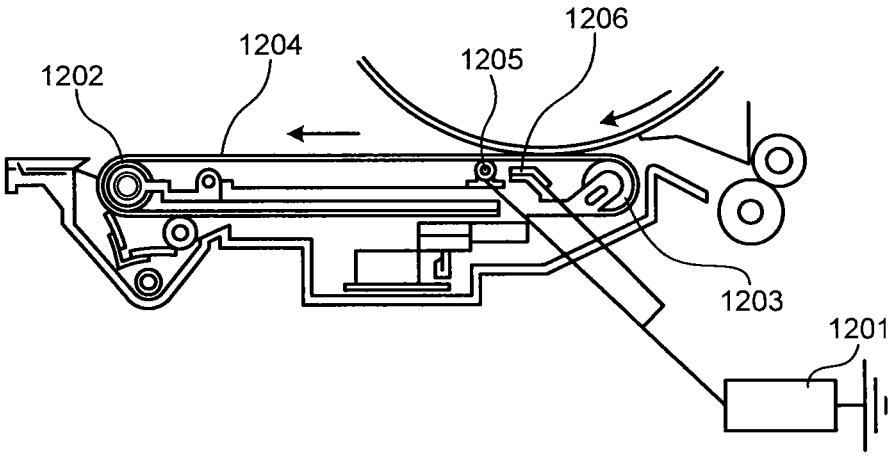
FIG. 10 is an explanatory view of a second modification.

In a structure illustrated in FIG. 10, the power supply structures of the embodiments may be applied to a power supply 1201. In the structure illustrated in FIG. 10, a mid-resistance transfer belt 1204 makes contact with a photosensitive drum, transfers toner to a sheet using a bias applied from the power supply 1201 to the transfer belt 1204, and conveys the sheet.

The structure of the image forming unit including the photosensitive drum is the same as that of the first embodiment. The transfer belt 1204, which is winded between a driving roller 1202 and a driven roller 1203, runs in an arrow direction in FIG. 10 by the rotation of the driving roller 1202. The transfer belt 1204 abuts the photosensitive drum at a position between the driving roller 1202 and the driven roller 1203. Inside the loop of the transfer belt 1204, a transfer bias roller 1205 and a bias brush 1206 are provided. They abut the transfer belt 1204 at respective positions downstream from an area in which the photosensitive drum and the transfer belt 1204 are abutted.

The photosensitive drum and the transfer bias roller 1205 are abutted and a transfer nip (not illustrated) is formed at the abutting area. The photosensitive drum is earthed while the transfer bias roller 1205 is connected to the power supply 1201 from which a transfer bias is applied to the transfer bias roller 1205. As a result, a transfer electric field that causes toner to electro-statically move from the photosensitive drum toward the transfer bias roller 1205 is formed between the photosensitive drum and the transfer bias roller 1205, and a toner image on the photosensitive drum is transferred, by actions of the transfer electric field and nip pressure, to the sheet fed toward the transfer nip.

Only any one of the transfer bias roller 1205 and the bias brush 1206 may be provided. Any one of the transfer bias roller 1205 and the bias brush 1206 may be provided directly under the transfer nip. A transfer charger may be used instead of the transfer bias roller 1205 and the bias brush 1206.

Third Modification

Figure 11:
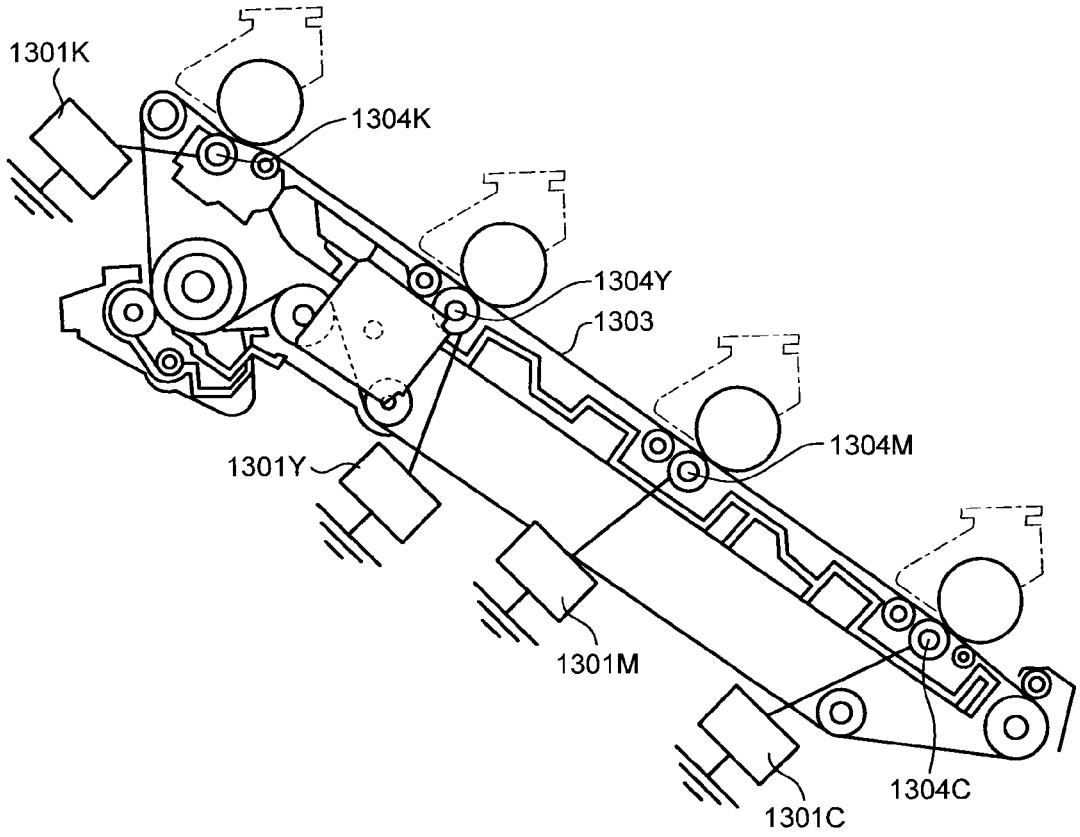
FIG. 11 is an explanatory view of a third modification.

In a structure illustrated in FIG. 11, the power supply structures of the embodiments may be applied to power supplies 1301C, 1301M, 1301Y, and 1301K. In the structure illustrated in FIG. 11, transfer rollers 1304C, 1304M, 1304Y, and 1304K for respective colors of CMYK make contact with corresponding photosensitive drums of the respective colors of CMYK with a transfer belt 1303 interposed therebetween. The respective transfer rollers 1304C, 1304M, 1304Y, and 1304K, to which the power supplies 1301C, 1301M, 1301Y, and 1301K apply biases, transfer toner to a sheet and the sheet is conveyed by the transfer belt 1303.

The structure of each of the image forming units including the corresponding photosensitive drums of the respective colors of CMYK is the same as that of the first embodiment except that the image forming units have different toner in color.

The transfer belt 1303, which is winded along and supported by a plurality of rollers, runs counterclockwise in FIG. 11. The transfer belt 1303 abuts the photosensitive drums of the respective colors. Inside the loop of the transfer belt 1303, the transfer rollers 1304C, 1304M, 1304Y, and 1304K for the respective colors are provided and abut the transfer belt 1303 so as to face the corresponding photosensitive drums of the respective colors.

The transfer roller 1304C and the photosensitive drum for C are abutted and a transfer nip is formed at the abutting area. The photosensitive drum for C is earthed while the transfer roller 1304C is connected to the power supply 1301C from which a transfer bias is applied to the transfer roller 1304C. The transfer bias applied to the transfer roller 1304C from the power supply 1301C forms a transfer electric field that causes toner of C to electro-statically move from the photosensitive drum for C toward the transfer roller 1304C in the transfer nip. In the other photosensitive drums for the respective colors, the transfer rollers, and the power supplies, the same operation as those described above is performed.

A sheet is conveyed from the right lower side in FIG. 11, and attached to the transfer belt 1303 by passing through a gap between a paper suction roller to which a bias is applied and the transfer belt 1303, and thereafter conveyed to the transfer nips of the respective colors. The respective color toner images on the photosensitive drums are sequentially transferred, by the actions of transfer electric field and nip pressure, to the sheet conveyed to the respective transfer nips. As a result, a full-color toner image is formed on the sheet.

The power supplies 1301C, 1301M, 1301Y, and 1301K, which are provided for the respective colors, may be replaced with a single power supply that may apply a bias to the transfer rollers 1304C, 1304M, 1304Y, and 1304K.

Fourth Modification

Figure 12:
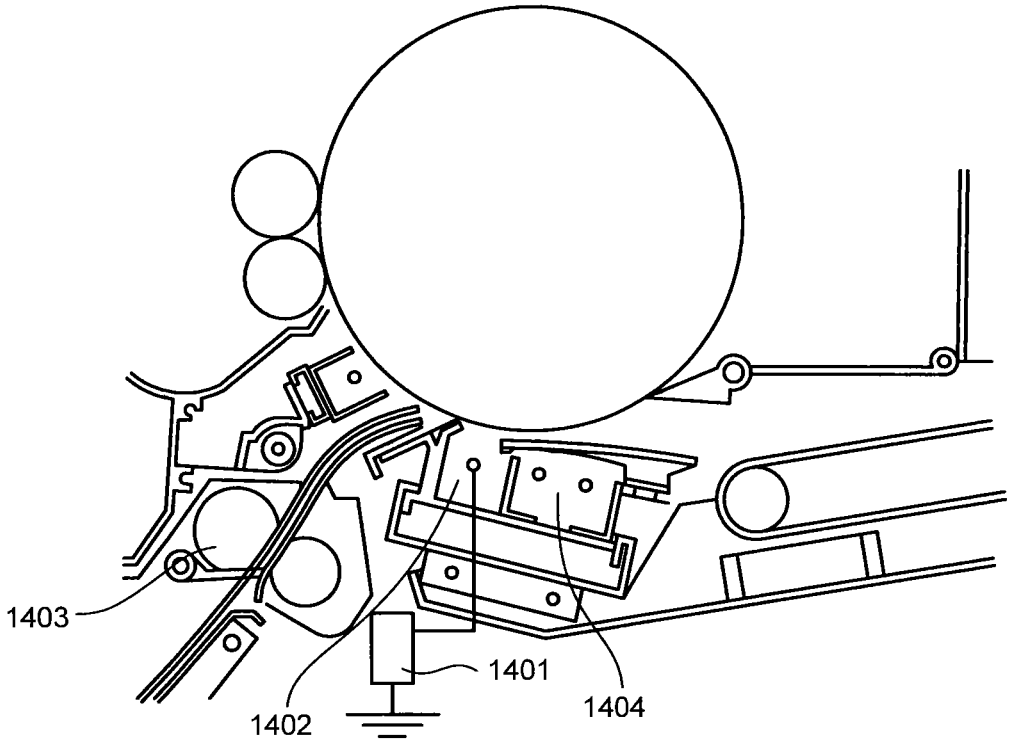
FIG. 12 is an explanatory view of a fourth modification.

A structure illustrated in FIG. 12 is a system in which a sheet is conveyed while subjected to the transfer operation and separating operation by a transfer charger 1402 and a separation charger 1404 that are arranged in the vicinity of a photosensitive drum. In the structure illustrated in FIG. 12, the power supply structures of the embodiments may be applied to a power supply 1401 when a bias is applied from the power supply 1401 to a wire of the transfer charger 1402 to transfer toner to the sheet and thereafter the sheet is conveyed.

The sheet passes through a registration roller 1403 and thereafter is subjected to the transfer operation by the transfer charger 1402 and separated by the separation charger 1404, and then conveyed to a fixing unit.

Fifth Modification

Figure 13:
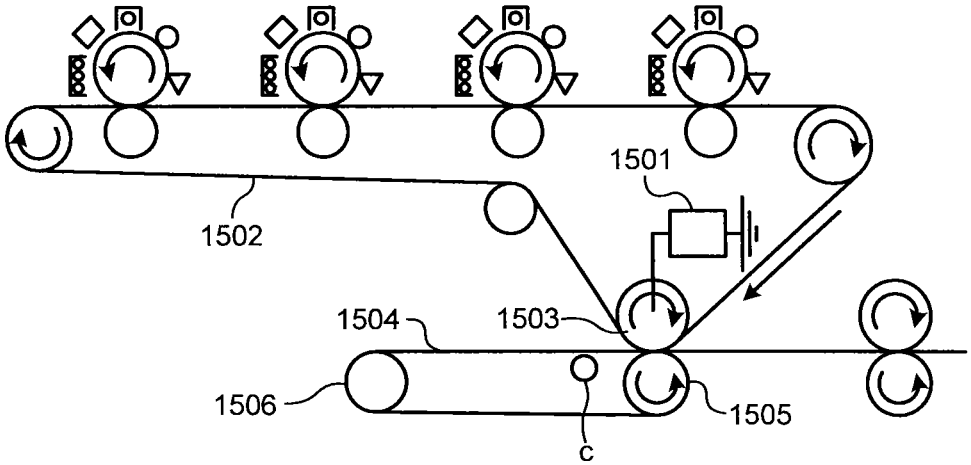
FIG. 13 is an explanatory view of a fifth modification.

A structure illustrated in FIG. 13 is a system in which a sheet is conveyed while subjected to the transfer operation and separating operation by an intermediate transfer belt 1502 and a secondary transfer belt 1504 making contact with the intermediate transfer belt 1502. In the structure illustrated in FIG. 13, the power supply structures of the embodiments may be applied to a power supply 1501 when a bias is applied from the power supply 1501 to an opposing roller 1503 to transfer toner to the sheet and thereafter the sheet is conveyed.

The structure of each of the image forming units including the corresponding photosensitive drums of the respective colors of CMYK is the same as that of the first embodiment except that the image forming units have different toner in color.

The secondary transfer belt 1504, which is wound between a driving roller 1505 and a driven roller 1506, runs counterclockwise in FIG. 13 by the rotation of the driving roller 1505. The secondary transfer belt 1504 abuts the intermediate transfer belt 1502.

The secondary transfer belt 1504 and the intermediate transfer belt 1502 are abutted and a secondary transfer nip is formed at the abutting area. The driving roller 1505 is earthed while the opposing roller 1503 is connected to the power supply 1501 from which a transfer bias is applied to the opposing roller 1503. As a result, a transfer electric field that causes toner to electro-statically move from the intermediate transfer belt 1502 toward the secondary transfer belt 1504 in the secondary transfer nip. A toner image on the intermediate transfer belt 1502 is transferred, by actions of secondary transfer electric field and nip pressure, to the sheet entering the secondary transfer nip.

Furthermore, the opposing roller 1503 may be earthed and a roller c may be provided so as to connect to the power supply 1501, from which a transfer bias may be applied to the roller c.

Sixth Modification

In the embodiments and modifications, the transfer operation is performed using toner charged to a negative polarity and the secondary transfer power supply that applies the negative polarity high voltage to the repulsive force roller 24 to apply a repulsive force to the toner. The transfer operation, however, is not limited to this manner. For example, the transfer operation may be performed by the secondary transfer power supply that applies a positive polarity high voltage to the secondary transfer roller 25 to apply an attractive force to the toner.

Seventh Modification

The embodiments and modifications described above are examples. It is confirmed that the transfer device according to the invention is able to be achieved by various structures and process conditions using other image forming apparatuses under various image forming environments.

According to the embodiments, it is possible to provide an advantage of improving image quality regardless of the surface smoothness of sheets.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. A transfer device, comprising:

a direct-current (DC) power supply configured to output a DC voltage;

an alternating-current (AC) power supply configured to selectively switch between a first output and a second output, the first output being a superimposed voltage in which an AC voltage is superimposed on the DC voltage output from the DC power supply, and the second output being only the DC voltage output from the DC power supply; and a transfer unit configured to transfer a developer to a sheet using the voltage output from the AC power supply, wherein the DC power supply includes a DC high voltage transformer that produces the DC voltage, the DC high voltage transformer including a primary winding and a secondary winding, the AC power supply includes an AC high voltage transformer that produces the AC voltage and an AC driving unit that drives the AC high voltage transformer, the AC high voltage transformer including a primary winding and a secondary winding, the secondary winding of the DC high voltage transformer, the secondary winding of the AC high voltage transformer, and the transfer unit are electrically connected in series in this order, when the AC power supply outputs the first output, the AC high voltage transformer is driven by the AC driving unit to produce the AC voltage and outputs, from the secondary winding of the AC high voltage transformer, the first output that is the superimposed voltage in which the AC voltage produced is superimposed on the DC voltage output from the secondary winding of the DC high voltage transformer, and when the AC power supply outputs the second output, the AC high voltage transformer outputs the second output from the secondary winding of the AC high voltage transformer to the transfer unit, the second output being the DC voltage output from the secondary winding of the DC high voltage transformer.

2. The transfer device according to claim 1, wherein the AC high voltage transformer has a withstanding voltage performance withstanding a maximum value of the superimposed voltage.

3. The transfer device according to claim 2, wherein a pitch of the secondary winding of the AC high voltage transformer on an input side withstanding a maximum output voltage of the DC power supply.

4. The transfer device according to claim 2, wherein the secondary winding of the AC high voltage transformer keeps an insulation distance from circuits including the primary winding in the AC high voltage transformer.

5. The transfer device according to claim 4, wherein the insulation distance is determined in accordance with at least one of a material of the AC high voltage transformer, a thickness of an insulator in the AC high voltage transformer, and a material of the insulator.

6. The transfer device according to claim 1, further comprising a cleaning power supply configured to output a DC voltage having a polarity opposite to a polarity of the DC voltage output from the DC power supply.

7. An image forming apparatus comprising the transfer device according to claim 1.

8. The image forming apparatus according to claim 7, wherein the transfer unit includes a repulsive force roller and a secondary transfer roller, and the repulsive force roller transfers a static toner pattern on an intermediate transfer belt to the sheet at a nip formed between the repulsive force roller and the secondary transfer roller.

9. The transfer device according to claim 1, wherein the DC voltage output as the second output is larger than the DC voltage output included in the superimposed voltage output as the first output.

10. A method of transferring a developer to a sheet, comprising:

selectively switching between a first output and a second output, from an alternating-current (AC) power supply, the first output being a superimposed voltage in which an AC voltage is superimposed on a DC voltage output from a direct-current (DC) power supply, the second output being only the DC voltage output from the DC power supply, the DC power supply includes a DC high voltage transformer that produces the DC voltage, the DC high voltage transformer including a primary winding and a secondary winding, the AC power supply includes an AC high voltage transformer that produces the AC voltage and an AC driving unit that drives the AC high voltage transformer, the AC high voltage transformer including a primary winding and a secondary winding, and the secondary winding of the DC high voltage transformer and the secondary winding of the AC high voltage transformer are electrically connected in series in this order;

transferring a developer to a sheet using the voltage output from the AC power supply;

when the AC power supply outputs the first output, driving the AC high voltage transformer by the AC driving unit to produce the AC voltage and outputting, from the secondary winding of the AC high voltage transformer, the first output that is the superimposed voltage in which the AC voltage produced is superimposed on the DC voltage output from the secondary winding of the DC high voltage transformer; and when the AC power supply outputs the second output, outputting with the AC high voltage transformer the second output from the secondary winding of the AC high voltage transformer to transfer the developer to the sheet, the second output being the DC voltage output from the secondary winding of the DC high voltage transformer.

* * * * *